US008640977B2

(12) United States Patent
Songbe

(10) Patent No.: US 8,640,977 B2
(45) Date of Patent: Feb. 4, 2014

(54) PUSH-BUTTON FOR A SYSTEM FOR DISPENSING A LIQUID UNDER PRESSURE

(75) Inventor: Jean-Pierre Songbe, Eu (FR)

(73) Assignee: Rexam Dispensing Systems S.A.S. (FR)

( * ) Notice: Subject to any disclaimer, the term of this patent is extended or adjusted under 35 U.S.C. 154(b) by 317 days.

(21) Appl. No.: 12/789,071

(22) Filed: May 27, 2010

(65) Prior Publication Data

US 2010/0308136 A1 Dec. 9, 2010

(30) Foreign Application Priority Data

Jun. 4, 2009 (FR) ..... 09 02713

(51) Int. Cl.
*B05B 1/34* (2006.01)
*B65D 83/28* (2006.01)
*B65D 83/30* (2006.01)

(52) U.S. Cl.
USPC ..... 239/490; 239/337; 239/463; 222/402.1

(58) Field of Classification Search
USPC ..... 239/333, 337, 461, 463, 468–470, 472, 239/474, 475, 487–494, DIG. 19; 222/321.1, 321.2, 321.7, 321.8, 383.1, 222/402.1, 402.13
See application file for complete search history.

(56) References Cited

U.S. PATENT DOCUMENTS

| | | | | |
|---|---|---|---|---|
| 3,785,571 | A * | 1/1974 | Hoening | 239/492 |
| 5,738,282 | A | 4/1998 | Grogan | |
| 5,992,765 | A * | 11/1999 | Smith | 239/493 |
| 6,371,389 | B1 * | 4/2002 | Bickart et al. | 239/491 |

FOREIGN PATENT DOCUMENTS

| | | | |
|---|---|---|---|
| DE | 19622124 | A1 | 12/1997 |
| EP | 1042072 | B1 | 6/2004 |
| EP | 1925553 | A1 | 5/2008 |
| FR | 2907106 | A1 | 4/2008 |
| WO | 03018208 | A1 | 3/2003 |

OTHER PUBLICATIONS

French Search Report and Written Opinion; FR 0902713; Nov. 12, 2009; 6 pages.

* cited by examiner

*Primary Examiner* — Darren W Gorman

(74) *Attorney, Agent, or Firm* — St. Onge Steward Johnston & Reens LLC

(57) ABSTRACT

A push-button for a dispensing system for a liquid under pressure, the push-button includes a body having a mounting well on a delivery tube for the liquid under pressure and a housing in communication with the well, the housing being provided with an anvil around which a spraying nozzle is mounted in such a way as to form a dispensing path of the fluid between the housing and a vortex unit including a vortex chamber provided with a dispensing orifice as well as at least one supply channel of the chamber, the nozzle having a proximal wall wherein is formed a print of the vortex unit and the anvil having a distal wall whereon the proximal wall of the nozzle is pressing against in order to delimit the vortex unit between them, the distal wall having a recess which is formed across from the print of the vortex chamber, the maximum depth of the recess being between 25% and 300% of the minimum depth of the print of the supply channels.

13 Claims, 1 Drawing Sheet

PUSH-BUTTON FOR A SYSTEM FOR DISPENSING A LIQUID UNDER PRESSURE

CROSS-REFERENCE TO RELATED APPLICATIONS

The present application claims priority of French patent application No. 09 02713 filed on Jun. 4, 2009, the content of which is incorporated herein by reference.

FIELD OF THE INVENTION

The invention relates to a push-button for a dispensing system for a liquid under pressure, as well as such a dispensing system.

BACKGROUND OF THE INVENTION

In a particular application, the dispensing system is intended to equip bottles used in perfumery, in cosmetics or for pharmaceutical treatments. Indeed, this type of bottle contains a liquid which is restored via a dispensing system comprising a device for tapping under pressure of said liquid, said system being actuated by a push-button in order to allow for the spraying of the liquid. In particular, the device for tapping comprises a pump or a manually-actuated valve by the intermediary of the push-button.

Such push-buttons are conventionally carried out in two portions: an actuator body and a spraying nozzle of the liquid which are associated together in order to form a vortex unit comprising a vortex chamber provided with a dispensing orifice as well as supply channels of said chamber. In particular, the vortex chamber is arranged in order to turn the liquid very rapidly so that it escapes by the orifice with a speed that is sufficient to break up into droplets forming the aerosol.

According to a known embodiment, the nozzle is mounted around an anvil formed in a housing of the body. The vortex unit is then delimited between a proximal wall of the nozzle wherein is formed a print of said vortex unit and a distal wall of said anvil which is conventionally planar. To do this, the nozzle is pressed on the anvil until the distal wall is thrust on the proximal wall and laterally closes the print in order to form the vortex unit.

Moreover, the carrying out of recesses of great depth in the distal wall of the anvil is known. In particular, FR 2 907 106 described such a recess for forming a vortex counter chamber in order to homogenise the aerosol and EP 1 042 072 propose a size of recess that is sufficient to overcome the problem of the residual flow.

The vortex unit is carried out at the interface between the nozzle and the anvil which, in particular due to their size, are parts that are difficult to produce industrially in large quantities while perfectly controlling the precision of their geometry. Furthermore, the assembly of the nozzle on the anvil must be carried out industrially at a high rate, which does not make it possible to guarantee an optimal positioning of said nozzle on said anvil.

This therefore results in a dispersion in the geometry of the vortex units, which directly affects the quality of the aerosol dispensed. In particular, the pressing of the nozzle against the anvil sometimes causes a deformation of the material of said anvil into the supply channels blocking them partially.

Furthermore, the distal wall can have after pressing a convex form disturbing the swirling of the liquid in the chamber. Moreover, the anvil can undergo deformations due to the removal of the material during its cooling after moulding producing its placing askew. The distal wall is then askew which results during pressing in the dissymmetrical partial concealing of certain supply channels and especially a distal wall that is not only convex, but that does not have a rotation symmetry. The aerosol produced is then referred to as "hollow", i.e. there are very few droplets in its centre, or deformed meaning that its impact is not circular, or offset, or askew in relation to the axis of the dispensing orifice.

SUMMARY OF THE INVENTION

The invention has for purpose to overcome the problems of prior art by proposing in particular a push-button wherein the quality of the aerosol generated by the vortex unit can be guaranteed independently of the dispersions of manufacture and/or of assembly of the spraying nozzle around the anvil of the actuator body.

To this effect, and according to a first aspect, the invention proposes a push-button for a dispensing system for a liquid under pressure, said push-button comprising a body having a mounting well on a delivery tube for the liquid under pressure and a housing in communication with said well, said housing being provided with an anvil around which a spraying nozzle is mounted in such a way as to form a dispensing path of the fluid between said housing and a vortex unit comprising a vortex chamber provided with a dispensing orifice as well as at least one supply channel of said chamber, said nozzle having a proximal wall wherein is formed a print of the vortex unit and said anvil having a distal wall whereon the proximal wall of the nozzle is pressing against in order to delimit said vortex unit between them, said distal wall having a recess which is formed across from the print of the vortex chamber, the maximum depth of said recess being between 25% and 300% of the minimum depth of the print of the supply channels.

According to a second aspect, the invention proposes a dispensing system for a liquid under pressure, comprising a device for tapping provided with a delivery tube for the liquid under pressure whereon the well of such a push-button is mounted in order to allow for the spraying of the liquid.

BRIEF DESCRIPTION OF THE DRAWINGS

Other objectives and advantages of the invention shall appear in the following description, made in reference to the annexed figures wherein.

DETAILED DESCRIPTION OF THE INVENTION

Figure 1:
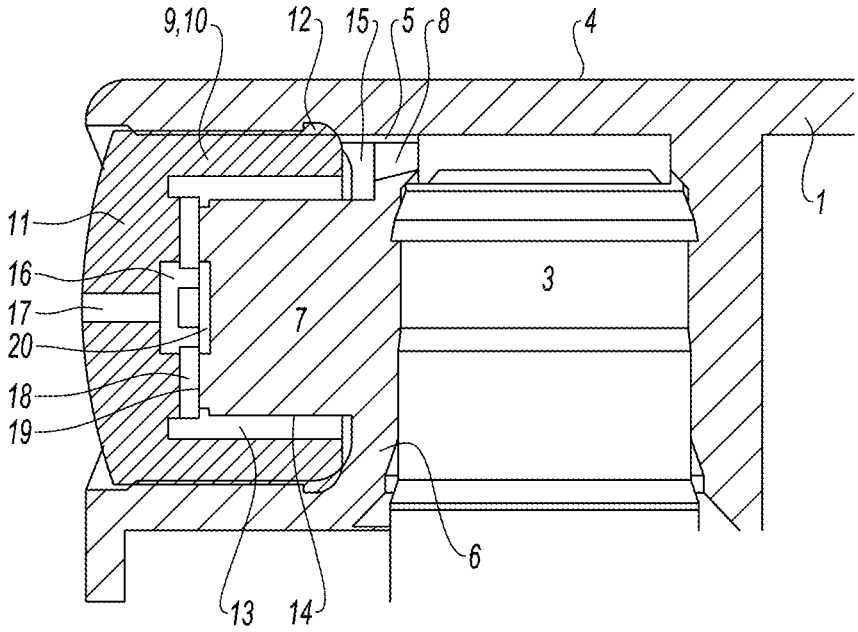
FIG. 1 is a partial longitudinal cross-section view of a push-button according to an embodiment of the invention.

In relation with the figures, a push-button for a dispensing system for a liquid under pressure is described hereinbelow, said liquid able to be of any nature, in particular used in perfumery, cosmetics or for pharmaceutical treatments.

The push-button comprises a body 1 having an annular skirt 2 which surrounds a mounting well 3 of the push-button on a delivery tube for the liquid under pressure. Moreover, the push-button comprises an upper zone 4 allowing the user to exert a press of the finger on said push-button in order to be able to displace it axially.

In particular, the dispensing system comprises a device for tapping provided with a delivery tube for the liquid under pressure (not shown) which is inserted sealingly into the well 3. In a known manner, the dispensing system further comprises means for mounting on a bottle containing the liquid and means of tapping of the liquid inside said bottle which are arranged in order to supply the delivery tube with liquid under pressure.

The device for tapping can include a manually-actuated pump or, in the case where the liquid is conditioned under pressure in the bottle, a manually-actuated valve. As such, during a manual displacement of the push-button, the pump or the valve is actuated in order to supply the delivery tube with liquid under pressure.

The body 1 also has an annular housing 5 with axis perpendicular to that of the mounting well 3, said housing having a rear wall 6 whereon extends axially a cylindrical anvil of revolution 7. Moreover, the housing 5 is in communication with the well 3 by the intermediary of an orifice 8 formed in the rear wall 6 in order to allow for the passage of the fluid brought by the tube from said well into said housing.

The push-button further comprises a spraying nozzle 9 which is associated to the body 1 by being mounted around the anvil 7 in such a way as to form a dispensing path of the fluid. In the embodiment shown, the nozzle 9 is arranged collinearly to the axis of the housing 5 in order to allow for a lateral spraying of the liquid relatively to the body 1 of the push-button.

In the embodiment shown, the nozzle 9 has a cylindrical lateral wall 10 of revolution which is closed towards the front by a proximal wall 11. The association of the nozzle 9 in the housing 5 is carried out via press fitting of the external face of the lateral wall 10, the rear edge of said external face being furthermore provided with a radial projection 12 for anchoring the nozzle 9 in said housing.

Advantageously, the nozzle 9 and the body 1 are carried out via moulding, in particular of a different thermoplastic material. Furthermore, the material forming the nozzle 9 has a rigidity which is higher than the rigidity of the material forming the body 1. As such, the substantial stiffness of the nozzle 9 makes it possible to avoid its deformation during the press fitting. Furthermore, the less substantial stiffness of the body 1 makes it possible on the one hand a more qualitative touch during the actuation and on the other hand an improved seal between the mounting well 3 and the delivery tube. Finally, the greater rigidity of the nozzle 9 makes it possible to improve the reliability of the harpooning of the protrusion 12 in the housing 5 in order to avoid the risk of expulsion of the nozzle 9 during the distribution.

In an example embodiment, the body 1 is made of polyolefin and the nozzle 9 is made of cyclic olefin copolymer (COC), of poly (oxymethylene) or of poly (butylene terephthalate).

The dispensing path comprises an annular duct 13 which is formed between the internal face of the lateral wall 10 of the nozzle 9 and the external face of the lateral wall 14 of the anvil 7. In the embodiment shown, this annular duct 13 is supplied with liquid under pressure coming from the orifice 8 by the intermediary of an upstream annular duct 15 which is formed between the lateral wall 14 and the housing 5.

On the downstream side, the annular duct 13 supplies with liquid under pressure a vortex unit comprising a vortex chamber 16 provided at its centre with a dispensing orifice 17 as well as with at least one supply channel 18 of said chamber. To do this, a print of the vortex unit is formed as a hollow on the rear face of the proximal wall 11 of the nozzle 9 and the anvil 7 has a distal wall 19 whereon the proximal wall 11 is pressing against in order to delimit said vortex unit between them.

In the embodiment shown, the vortex unit comprises four radial supply channels 18 which exit laterally into the vortex chamber 16, said channels having a constant U-shaped section. However, a different number of supply channels 18 can be provided, with possibly a modified orientation and/or geometry, as well as another method of supply of the vortex chamber 16.

The distal wall 19 has a recess 20 which is formed across from the print of the vortex chamber 16, the maximum depth of said recess being between 25% and 300% of the minimum depth of the print of the supply channels 18. In the embodiment shown, the depth of the supply channels 18 is constant and analogous to that of the vortex chamber 16.

According to the invention, the depth of the recess 20 is sufficient to guarantee that, after pressing of the nozzle 9 on the anvil 7, the geometry of the distal wall 19 which is arranged across from the vortex chamber 16 is never convex, and this taking into account the dispersions of manufacture and of assembly of the nozzle 9 around the anvil 7. Furthermore, the depth of the recess 20 is sufficiently limited so as not to interact in a notable manner with the characteristics of the aerosol dispensed, in particular as not being sufficiently large enough to form a vortex counter chamber. As such, the quality of the aerosol remains identical from one manufacture to another which maintaining high rates of manufacture and assembly.

Preferentially, these effects are obtained when the maximum depth of the recess 20 is between 50% and 150% of the minimum depth of the print of the supply channels 18. Furthermore, the recess 20 can have an opening of which the dimension is between 80% and 110% of the diameter of the vortex chamber 16, in particular being substantially equal to said diameter.

Figure 2:
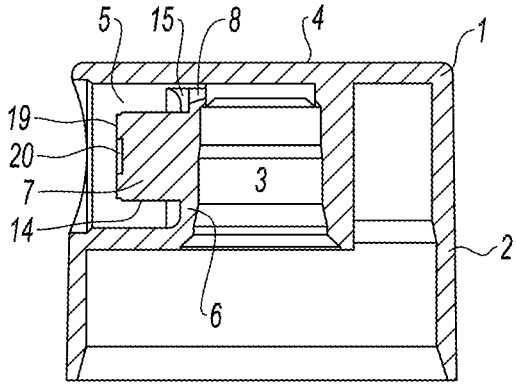
FIG. 2 is a longitudinal cross-section view of the actuator body of the push-button according to FIG. 1.
Figure 3:
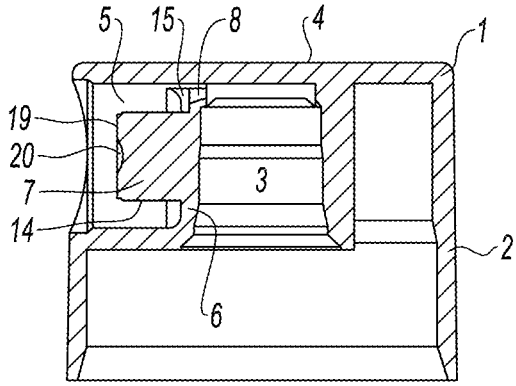
FIG. 3 is a longitudinal cross-section view of an alternative of the actuator body according to FIG. 2.

In the embodiment shown, the recess 20 has a geometry of revolution, more precisely cylindrical of revolution in FIGS. 1 and 2. Alternatively, a slightly tapered or semi-elliptic geometry can be provided as shown in FIG. 3.

In an example embodiment, the diameter of the vortex chamber 16 is 0.6 mm, the supply channels 18 have a depth of 0.33 mm for a width of 0.2 mm, the diameter of the recess 20 is between 0.5 and 0.6 mm for a depth before pressing between 0.1 and 0.5 mm. After pressing of the nozzle 9 on the anvil 7, the distal wall 19 remains concave or flat but is never convex.

What is claimed is:

1. A push-button for a dispensing system for a liquid under pressure, said push-button comprising a body having a mounting well on a delivery tube for the liquid under pressure and a housing in communication with said well, said housing being provided with an anvil around which a spraying nozzle is mounted in such a way as to form a dispensing path of the liquid between said housing and a vortex unit comprising a vortex chamber provided with a dispensing orifice as well as at least one supply channel of said chamber, said nozzle having a proximal wall wherein is formed a print of the vortex unit and said anvil having a distal wall whereon the proximal wall of the nozzle is pressing against in order to delimit said vortex unit between them, said distal wall having a recess which is formed across from the print of the vortex chamber, wherein the maximum depth of said recess is between 25% and 300% of the minimum depth of the print of the at least one supply channel, wherein the maximum depth of the recess is limited as not to disturb swirling of the liquid in the vortex chamber, and wherein the recess has an opening a dimension of which is between 80% and 110% of a diameter of the vortex chamber.

2. The push-button according to claim 1, wherein the maximum depth of the recess is between 50% and 150% of the minimum depth of the print of the at least one supply channel.

3. The push-button according to claim 1, wherein the at least one supply channel comprises a plurality of radial supply channels which exit laterally into the vortex chamber.

4. The push-button according to claim 1, wherein the recess has a geometry of revolution.

5. The push-button according to claim 1, wherein the material forming the nozzle has a rigidity which is higher than the rigidity of the material forming the body.

6. The push-button according to claim 1, wherein the nozzle and the anvil each have a lateral wall wherein between an annular duct of the dispensing path is formed, said duct being in communication on either side respectively with the well and with the at least one supply channel.

7. The push-button according to claim 6, wherein an external face of the lateral wall of the nozzle is press-fitted into the housing.

8. The push-button according to claim 7, wherein a rear edge of the external face is provided with a radial protrusion for anchoring the nozzle in the housing.

9. The push-button according to claim 4, wherein the recess has a uniform depth.

10. The push-button according to claim 1, wherein the recess has a semi-elliptic geometry.

11. The push-button according to claim 1, wherein the distal wall of the anvil circumscribing the recess is flat.

12. The push-button according to claim 1, wherein a diameter of the recess is between 0.5 and 0.6 mm.

13. The push-button according to claim 12, wherein the depth of the recess is between 0.1 and 0.5 mm.

* * * * *